US008708657B2

(12) United States Patent
Bayley

(10) Patent No.: US 8,708,657 B2
(45) Date of Patent: Apr. 29, 2014

(54) ROTOR DISC

(75) Inventor: Nicholas Bayley, Derby (GB)

(73) Assignee: Rolls-Royce PLC, London (GB)

( * ) Notice: Subject to any disclaimer, the term of this patent is extended or adjusted under 35 U.S.C. 154(b) by 527 days.

(21) Appl. No.: 13/010,157

(22) Filed: Jan. 20, 2011

(65) Prior Publication Data

US 2011/0182751 A1 Jul. 28, 2011

(30) Foreign Application Priority Data

Jan. 22, 2010 (GB) ..... 1000982.7

(51) Int. Cl.

| | |
|---|---|
| ***F01D 5/18*** | (2006.01) |
| ***F01D 5/30*** | (2006.01) |
| ***F01D 5/02*** | (2006.01) |
| ***F01D 5/08*** | (2006.01) |

(52) U.S. Cl.

CPC ..... *F01D 5/021* (2013.01); *F01D 5/085* (2013.01); *F01D 5/3023* (2013.01); *F01D 5/3069* (2013.01); *F05D 2260/20* (2013.01)

USPC ..... 416/219 R; 416/97 R; 416/220 R; 415/116

(58) Field of Classification Search

CPC ..... F01D 5/021; F01D 5/085; F01D 5/3023; F01D 5/3069; F01D 2260/2029

USPC ..... 415/115, 116; 416/97 R, 215, 216, 217, 416/219 R, 220 R; 29/889.2

See application file for complete search history.

(56) References Cited

U.S. PATENT DOCUMENTS

| | | | | |
|---|---|---|---|---|
| 2,401,826 | A * | 6/1946 | Halford | 416/97 R |
| 2,628,066 | A * | 2/1953 | Lombard et al. | 416/97 R |
| 2,931,623 | A | 4/1960 | Hyde | |
| 2,931,624 | A | 4/1960 | Hyde | |
| 4,086,757 | A * | 5/1978 | Karstensen et al. | 60/791 |
| 6,416,282 | B1 * | 7/2002 | Beeck et al. | 416/97 R |
| 7,007,382 | B2 * | 3/2006 | Mantel | 29/889.2 |

FOREIGN PATENT DOCUMENTS

| | | |
|---|---|---|
| EP | 0 859 128 A1 | 8/1998 |
| EP | 0 905 352 A2 | 3/1999 |
| GB | 578009 | 6/1946 |
| GB | 810459 | 3/1959 |
| GB | 1 525 934 | 9/1978 |

OTHER PUBLICATIONS

Search Report issued in British Application No. GB 1000982.7 dated Mar. 24, 2010.

* cited by examiner

*Primary Examiner* — Igor Kershteyn
(74) *Attorney, Agent, or Firm* — Oliff PLC

(57) ABSTRACT

A rotor disc 2 is provided with blade receiving recesses 40 at its outer periphery. The disc 2 has an internal cavity 34 for conveying cooling air to blades 4 retained in the recesses 40. Each blade-receiving recess 40 intersects the cavity 34 to provide communication between the cavity 34 and the recesses 40. The disc 2 may be made from separate disc components 12, 14 which define the cavity 34 between them.

12 Claims, 1 Drawing Sheet

ROTOR DISC

This invention relates to a rotor disc, and is particularly, although not exclusively, concerned with a rotor disc for a gas turbine engine. The invention also relates to a rotor comprising a rotor disc and an array of blades, and to a method of manufacturing a rotor disc.

A rotor disc for a gas turbine engine typically comprises an annular diaphragm portion having a cob portion at its radially inner periphery and a rim portion at its radially outer periphery. The rim portion is provided with blade-receiving recesses, for example in the form of slots, for receiving blade roots in a manner which retains the blades on the disc.

Most gas turbine engines have a secondary air system which, among other functions, serves to cool components of the engine. For example, rotor blades may be cooled by supplying cooling air from the secondary air system to the rotor disc and thence to passages within the blades.

In pursuit of efficiency, there is a trend for gas turbine engines to have smaller, faster and hotter engine cores. Disc rim loads have consequently increased. Constraints on shaft design mean that it has not been possible to reduce disc bore diameters in proportion to the reduction in rim diameter. Consequently, discs have been designed with larger cob volumes in order to provide adequate support for the higher disc loads within the space constraints that are imposed.

As disc cob size increases, so does the thermal inertia. When the engine undertakes a rapid acceleration this thermal inertia results in a large temperature gradient between the cob centre and the bore surface as well as the disc rim and bore. This gradient generates a large compressive axial stress at the bore surface, the diaphragm and rim of the disc. When combined with the hoop stress resulting from the rotational loading, this biaxial field has a large Von-Mises stress. A large Von-Mises stress results in a low fatigue life for the disc.

It is known, for example from U.S. Pat. No. 2,931,623 and U.S. Pat. No. 2,931,624, to provide a split rotor disc comprising two disc components which are secured to each other at a radial interface. Each component has its own cob so that, although the overall cob volume may be approximately the same as that of a unitary disc, the volume of the cob of each component is significantly smaller. This reduces transient thermal gradients and consequently the Von-Mises stresses.

In the split rotors of U.S. Pat. No. 2,931,623 and U.S. Pat. No. 2,931,624, the two disc components form between them an annular cavity which receives air from the secondary air system. This air is then supplied through passages in the disc to cooling passageways in the blades.

It is undesirable to form passages in the disc, because such passages constitute stress concentration features in a very highly stressed region of a critical part. If the passage is in the form of a relatively long hole, the material surface condition resulting from manufacture of the hole is inferior to that achievable in most other areas of the disc. This comparatively poor surface condition, coupled with the high stress in the hole, leads to a low fatigue life limit for the disc.

According to one aspect of the present invention there is provided a rotor disc provided with blade receiving recesses at its outer periphery, the recesses extending fully between opposite axial end faces of the disc, wherein the disc comprises two axially adjoining disc components defining an internal cavity therebetween for conveying cooling air, each blade-receiving recess intersecting the cavity to provide communication between the cavity and the blade-receiving recesses.

The cavity may be annular, and centred on the rotational axis of the disc. The bases of the recesses may be situated radially inwardly of the radially outer extremity of the cavity.

Each recess may have a fir-tree configuration terminating at its inner end at a bucket groove. The intersection between each recess and the cavity may be confined to the bucket groove.

The disc may comprise a cob portion and a rim portion, with a diaphragm portion extending between the cob portion and the rim portion, the cavity extending through the diaphragm portion from the cob portion and terminating within the rim portion, the blade receiving recesses being disposed in the rim portion.

The present invention also provides a rotor comprising a rotor disc as defined above, and a circumferential array of blades, the blades having blade roots engaging the respective blade-receiving recesses, and being provided with internal passages opening into the respective blade-retaining recesses.

Annular sealing plates may be secured to the disc to seal the axial ends of the blade-retaining recesses.

Radial channels may be provided between each blade root and the respective blade-retaining recess to provide a flow path from the blade-retaining recess to a shank cavity of the blade. Where the rotor disc is formed from two components, the radial channels may be formed at the join between the disc components, whereby contact between the blade root and the disc is avoided at the join.

According to another aspect of the present invention, there is provided a method of manufacturing a rotor disc, the method comprising forming a disc body by adjoining two disc components in axial face-to-face contact to define therebetween an internal cavity, and subsequently forming blade-receiving recesses which extend fully between opposite axial end faces of the disc at the outer periphery of the disc body, the blade-receiving recesses intersecting the cavity.

The disc body may be formed by securing together two disc components in axial face-to-face contact, which components define the cavity between them.

For a better understanding of the present invention, and to show more clearly how it may be carried into effect, reference will now be made, by way of example, to the accompanying drawings, in which:—

Figure 1:
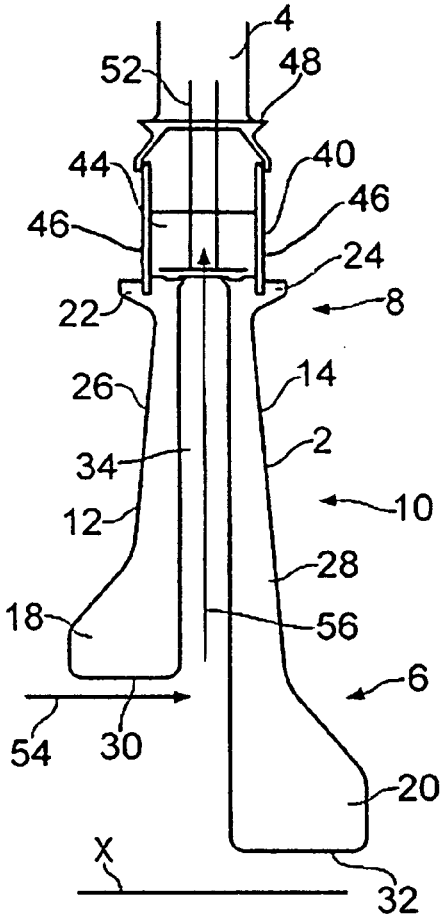
FIG. 1 is a sectional view of a rotor of a gas turbine engine.

The rotor of FIG. 1 comprises a disc 2 provided at its periphery with an circumferential array of blades of which a single blade 4 is shown. The disc 2 is annular and has a central axis X which coincides with the axis of rotation of the rotor. The disc 2 comprises a cob portion 6 at its inner periphery, a rim portion 8 at its outer periphery, and a diaphragm portion 10 extending between the cob portion 6 and the rim portion 8.

Figure 2:
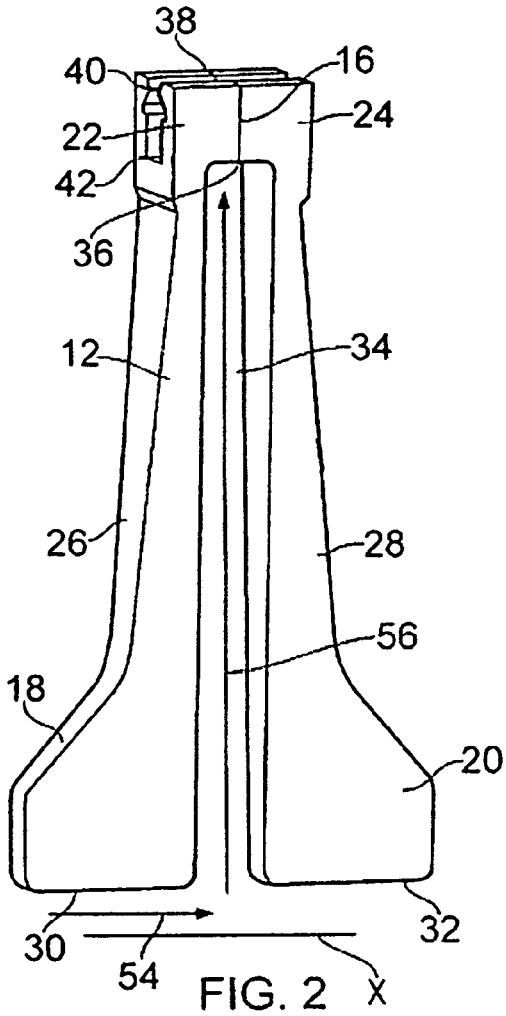
FIG. 2 is a schematic sectional view of a disc of the rotor of FIG. 1.

The disc 2 is constructed from two disc components 12, 14 which meet each other at a radial interface 16 (see FIG. 2). Each disc component 12, 14 has a respective cob 18, 20, rim 22, 24 and diaphragm 26, 28, which together make up the respective cob portion 6, rim portion 8 and diaphragm 10, ft will be appreciated from FIG. 1 that the inner peripheries 30, 32 of the cobs 18, 20, which define the disc bore, have different diameters, although this is not shown in FIG. 3 for the sake of simplicity.

The components 12, 14 define between them an annular cavity 34 which is centred on the axis X. The cavity is open at its inner periphery to the bore defined by the inner peripheries 30, 32 of the cobs 18, 20. At its outer periphery 36, the cavity terminates within the rim portion 8, short of the outer periphery 38 of the disc.

An array of blade receiving recesses or slots 40 is formed in the rim portion 8. Each slot 40 is of fir tree configuration, and terminates at its inner end in a bucket groove 42. Each slot 40 receives a root 44 of the respective blade 4. Lockplates 46 are secured to the disc 2 to retain the blades 4 in the slots 40, and may perform a sealing function to prevent leakage of air from the slots 40 in the axial direction of the disc 2. For this purpose, the lockplates 46 make sealing engagement with the rims 22, 24 and with platforms 48 of the blades 4.

Figure 3:
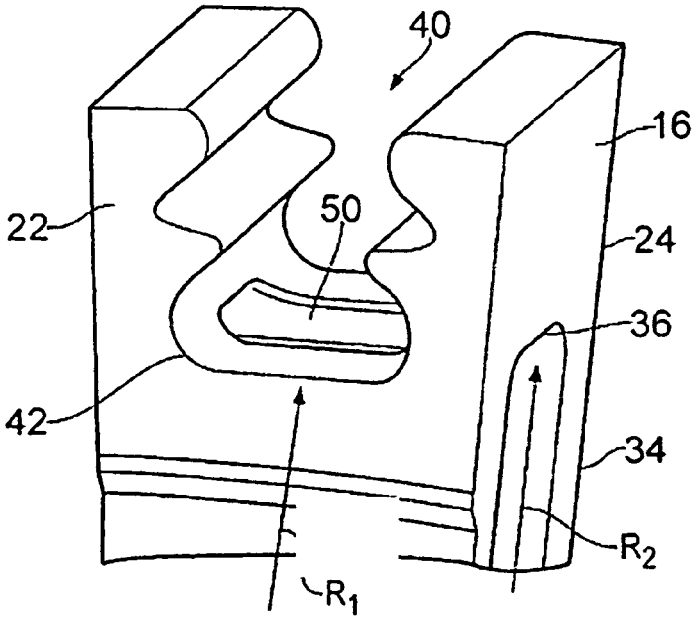
FIG. 3 is an enlarged view of a blade receiving slot of the disc of FIG. 2.

As shown in FIG. 3, each slot 40 intersects the cavity 34. In other words, the radius $R_1$ of the radially innermost part of the bucket groove 42 is smaller than the radius $R_2$ of the outer periphery 36 of the cavity 34. The consequence of this is that the cavity 34 opens into the bucket groove 42, and thus into the slot 40, at an opening 50.

Each blade 4 is provided with internal passageways 52 which are represented diagrammatically in FIG. 1. In operation of the engine, air from the secondary air system, for example air bled from the compressor of the engine, is supplied through the central bore of the disc 2 to the cavity, as indicated by an arrow 54. The air flows into the cavity 34 and radially outwardly to the opening 50, as indicated by an arrow 56. The air then enters the bucket groove 42 and passes to the passageways 52 to cool the blade 4.

Since the surfaces of the components 12, 14 which define the cavity 34 are highly accessible before the components are assembled together to form the disc 2, they can be finished to a high surface condition. Similarly, the slots 40 are accessible after initial forming for finishing treatment to a high surface condition. Consequently, fatigue life degradation associated with poor surface condition can be reduced or eliminated by the direct communication between the cavity 34 and the slots 40 achieved by forming them in the intersecting manner described above. Because the disc is formed from the initially separate components 12, 14, each with their own cob 18, 20, the individual cob volumes are relatively low, so reducing transient thermal gradients. This avoids excessive stresses, so further enhancing the fatigue life of the disc 2.

The disc may be manufactured by any suitable method utilising techniques well known to the person skilled in the manufacture of aerospace components. In one particular manufacturing process, the components 12, 14 are first manufactured separately and then secured together to form a disc body before the axial slots 40 are formed. The disc body thus includes the cavity 34 which is closed around its full outer periphery 36. The slots are then formed to a depth which is greater than the radial distance between the outer periphery 36 of the cavity 34 and the outer periphery 38 of the disc. The join is at the rim of the disc components and the parts are secured by a weld or inertia bond. It will appreciated that other joining methods may be used provided they achieve the required join integrity despite the high thermal and centrifugal stresses that the disc is subjected to in operation.

As shown in FIGS. 2 and 3, each blade-receiving recess 40 extends entirely across the axial extent of the rim portion 8 of the disc 2 and has a constant cross-section throughout its length.

In a modification of the disc shown in FIGS. 1 to 3, radially-extending channels may be provided in the wall of each blade-receiving recess in order to enable cooling air to flow from the cavity 34 along the channels to the outer periphery of the disc 2, where they may communicate with a shank cavity in a region of the blade between the fir-tree blade root 44 and the aerofoil portion of the blade 4. Preferentially, such channels may be formed along the join 16 between the two disc components 12, 14. This avoids direct contact between the blade root 44 and the walls of the recess 40 at the join 16, so avoiding high fir-tree edge of bedding stresses coinciding with the join 16.

It will be appreciated that the communication between the cavity 34 and the blade-retaining recess 40 is achieved without the requirement to form a machined hole in the rim portion 8. Consequently, any reduction in fatigue life caused from poor surface condition of such holes is eliminated.

Also, the assembly of the disc 2 from two disc components 12, 14 means that the disc cobs 18, 20 have reduced thermal inertia compared with the single cob of an equivalent unitary disc. This reduces the bore Von-Mises stresses under transient conditions, resulting in a higher fatigue life at the disc bore. The thermal gradient induced stresses in the diaphragm and rim are reduced, resulting in higher fatigue life in these areas.

The axial blade-receiving recesses 40 are machined through the join 16 at the blade rim 8, and this relieves any residual hoop stresses resulting from the joining together of the two components 12, 14. Also, with the construction shown in FIGS. 1 to 3, the join 16 is not subjected to hoop stress in operation, owing to the lack of continuity in the rim portion 8 in the hoop direction.

Rim sealing, achieved by the lockplates 46, is separated from the air supply system, to the passageways 52. Consequently, rim sealing is not compromised by the need to accommodate a blade air feed system in the same zone. The air supply follows a direct path from the cavity 34, through the opening 50 to the blade passageways 52 offering increased efficiency of the blade cooling feed system and reduces the cooling air heat pickup.

Although the invention has been described with reference to a disc 2 made from separate components 12, 14, the invention may also be applied to a unitary disc, for example a disc made from a single forging. Also, as shown in FIG. 1, where separate components 12 and 14 are assembled to form the disc 2, it is not essential for the two components 12, 14 to be mirror images of each other. For example, as shown in FIG. 1, the bore diameter may be different for the two components 12, 14. Also, one diaphragm 26 may be thinner than the other diaphragm 28. Furthermore, the join 16 need not necessarily be at the axial central plane of the disc 2.

The invention claimed is:

1. A rotor disc provided with blade receiving recesses at its outer periphery and opposing axially forward facing and axially rearward facing end faces, the blade receiving recesses extending entirely across an axial extent of a rim portion of the disc wherein the disc comprises two axially adjoining disc components, each disc component having respective cob portions relative to the other disc component, the inner peripheries of the respective cob portions having different diameters, the opposing axially forward facing and rearward facing end faces being joined together in axial face-to-face contact at the rim portion, and defining an internal cavity therebetween for conveying cooling air, each blade-receiving recess intersecting the cavity to provide communication between the cavity and the blade-receiving recesses.

2. A method of manufacturing a rotor disc, the method comprising forming a disc body by adjoining two disc components in axial face-to-face contact to define therebetween an internal cavity, and subsequently forming blade-receiving recesses which extend fully between opposite axial end faces of the disc at the outer periphery of the disc body, the blade-receiving recesses intersecting the cavity, each disc component having respective cob portions relative to the other disc component, the inner peripheries of the respective cob portions having different diameters.

3. A rotor disc comprising:

two axially adjoining disc components, each disc component having respective cob portions relative to the other disc component, the inner peripheries of the respective cob portions having different diameters;

the axially adjoining disc components having opposing axially forward facing and axially rearward facing end faces joined together in an axial face-to-face contact at a rim portion and defining an internal cavity configured to convey cooling air; and a plurality of blade-receiving recesses oriented at an outer periphery of the rotor disc, the blade receiving recesses extending entirely across an axial extent of the rim portion of the disc and configured to intersect the internal cavity to provide communication for the cooling air between the internal cavity and the plurality of blade-receiving recesses.

4. A rotor disc as claimed in claim 3, in which the cavity is annular, and centred on a rotational axis of the disc.

5. A rotor disc as claimed in claim 4, in which bases of the recesses are situated radially inwardly of a radially outer extremity of the cavity.

6. A rotor disc as claimed in claim 3, in which each recess has a fir-tree configuration terminating at an inner end of the recess at a bucket groove.

7. A rotor disc as claimed in claim 6, in which the intersection between each recess and the cavity is confined to the bucket groove.

8. A rotor disc as claimed in claim 3, in which the disc comprises a cob portion and a rim portion, with a diaphragm portion extending between the cob portion and the rim portion, the cavity extending through the diaphragm portion from the cob portion and terminating within the rim portion, the blade receiving recesses being disposed in the rim portion.

9. A rotor comprising a rotor disc as claimed in claim 3 and a circumferential array of blades, the blades having blade roots engaging the respective blade-receiving recesses and being provided with internal passages opening into the respective blade-retaining recesses.

10. A rotor as claimed in claim 9, in which annular sealing plates are secured to the disc to seal the axial ends of the blade-retaining recesses.

11. A rotor as claimed in claim 9, in which radial channels are provided between each blade root and the respective blade-retaining recess to provide a flow path from the blade-retaining recess to a shank cavity of the blade.

12. A rotor as claimed in claim 11, in which the radial channels are formed at a join between the disc components, whereby contact between the blade root and the disc is avoided at the join.

* * * * *